US007285054B1

(12) United States Patent
Morrision

(10) Patent No.: US 7,285,054 B1
(45) Date of Patent: Oct. 23, 2007

(54) GOLF SKILL DEVELOPMENT AND PRACTICE DEVICE

(76) Inventor: William Morrision, c/o 300, 1324 - 17th Avenue S.W., Calgary, Alberta (CA) T2T 5S8

( * ) Notice: Subject to any disclaimer, the term of this patent is extended or adjusted under 35 U.S.C. 154(b) by 0 days.

(21) Appl. No.: 11/737,862

(22) Filed: Apr. 20, 2007

Related U.S. Application Data

(60) Provisional application No. 60/820,974, filed on Aug. 1, 2006.

(51) Int. Cl.
*A63B 69/36* (2006.01)

(52) U.S. Cl. ..... 473/149; 473/139; 473/143

(58) Field of Classification Search ..... 473/138, 473/139, 143–147, 149, 219
See application file for complete search history.

(56) References Cited

U.S. PATENT DOCUMENTS 1,777,034 A 9/1930 Byrne
2,080,653 A * 5/1937 Craft ..... 473/143
2,095,062 A 10/1937 Glancey
2,213,570 A 9/1940 Rohland
2,297,118 A 9/1942 Wildegans
2,470,807 A * 5/1949 Davis, Jr. ..... 473/145
2,818,255 A 12/1957 Ponza
5,056,790 A * 10/1991 Russell ..... 473/143
5,560,604 A 10/1996 Watts
6,129,637 A 10/2000 Wang et al.
7,040,997 B2 * 5/2006 Rayburn ..... 473/143

* cited by examiner

*Primary Examiner*—Nini F. Legesse
(74) *Attorney, Agent, or Firm*—Bay Area Patent Group, LLC

(57) ABSTRACT

An apparatus for developing and practicing golf skills that is readily portable and which can be used in a relatively restricted or confined areas is provided. The apparatus includes a shot indicator mounted on a vertical shaft which is caused to rise on the vertical shaft during use as indicator of the effectiveness of the shot in terms of distance of flight which would have been attained by a golf ball if driven by a blow of equal force and direction. The shot indicator is caused to rise on the vertical shaft by a user hitting a target which is laterally spaced from the vertical shaft. A target support is rotatably attached to the vertical shaft at one end and supports the target at an opposite end. Rotation of the target support releases a compression spring which acts on the shot indicator causing it to rise on the vertical shaft.

17 Claims, 4 Drawing Sheets

GOLF SKILL DEVELOPMENT AND PRACTICE DEVICE

CROSS-REFERENCE TO RELATED APPLICATIONS

This application claims the benefit of U.S. Provisional Application No. 60/820,974, filed Aug. 1, 2006, the entire of which is incorporated herein by reference.

BACKGROUND OF THE INVENTION

1. Field of the Invention

The present invention relates generally to golf skill development and practice devices. More particularly, relating to a portable golf skill development and practice device that provides indication of the effectiveness of a practice shot.

2. Summary of the Prior Art

To play golf proficiently, a golfer must develop and maintain a proper swing. In order to develop and maintain a proper swing a golfer must devote a substantial amount of time practicing. Normally, a golfer must go to a golf course or driving range to practice. Many times a golf course or driving range is not feasible to visit and can be relatively expensive and quite time consuming. Consequently, there has long been a need for an inexpensive, relatively simple device which would permit a golfer to realistically practice a golf swing in a relatively restricted or confined area, such as a yard, or a park.

SUMMARY OF THE INVENTION

In accordance with the present invention, an apparatus for developing and practice golf skills that is readily portable and which can be used in a relatively restricted or confined areas is provided.

In general, in one aspect, an apparatus for the practice and development of golf skills is provided. The apparatus includes a vertical shaft having opposed first and second ends. The second end being formed into a point allowing the vertical shaft to be inserted into a support surface. A target and a means for supporting the target at a lateral distance from the vertical shaft. The means for supporting the target is rotatable about the vertical shaft. A shot indicator having a bore through which the vertical shaft extends such that the shot indicator is slidable along the vertical shaft, and the shot indicator being positioned above the means for supporting the target. A compression spring and a latch means for releasably securing the compression spring in a compressed position, wherein rotation of the means for supporting the target about the vertical shaft releases the latch means from securing the compression spring in the compressed position allowing the compression spring to abruptly expand causing the shot indicator to rise on the vertical shaft. The height the shot indicator rises on the vertical shaft indicates the effectiveness of the shot in terms of distance of flight which would have been attained by a golf ball if driven by a blow of equal force and direction.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
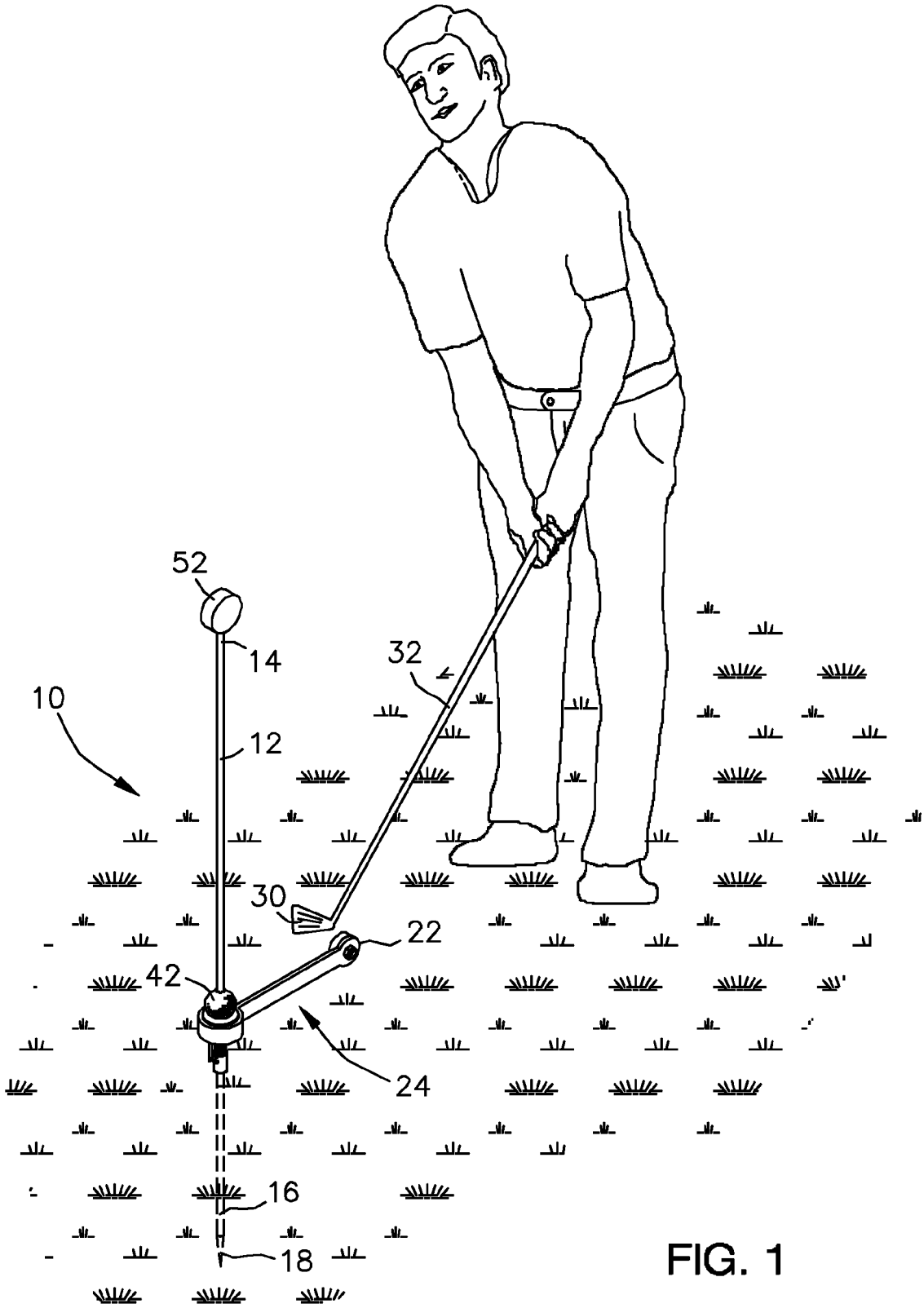
FIG. 1 is a perspective view of an apparatus for developing and practicing golf skills in use showing a golfer addressing the apparatus to practice a golf swing.

Referring now to the drawings, a preferred embodiment of the apparatus for developing and practicing golf skills of the present invention is shown and generally designated by the reference numeral 10.

With reference now to FIGS. 1-5, the apparatus 10 includes a vertical shaft 12 having opposed first and second ends 14 and 16. The second end 16 is formed into a point 18 so that the apparatus 10 can be secured to a ground surface 20 by inserting the second end into the ground as you would a typical ground stake.

A target 22 is lateral spaced from the vertical shaft 12 and is supported by a target support means 24. The target 22 can be generally circular in shape and have a diameter to correspond to the diameter of a typical golf ball. The target 22 has a striking face 26 to which is attached a pad 28 that prevents the club head 30 of a golf club 32 from becoming marred during use of the apparatus 10. The target 22 could also be a half sphere representing a golf ball or a full sphere representing a golf ball.

The target support means 24 extends laterally from the vertical shaft 12 and is rotatable about the shaft. The target support means 24 can include an arm 34 having a first end 36 with a bore hole 38 through which the vertical shaft 12 extends such that the arm is rotatable about the vertical shaft. Further, the arm 34 can be rotatably slidable along the vertical shaft 12. In other words, the arm 34 is free to both rotate about the vertical shaft 12 and can slide along a length of the vertical shaft. The arm 34 terminates a lateral distance from the first end 36 at a second end 40 which supports the target 22. The arm 34 can be formed of a material that is flexible, rigid or semi-rigid. Flexible meaning the material forming the arm 34 has a high modulus of elasticity and the arm will greatly deflect or bend when the target 22 is struck, and semi-rigid meaning the material forming the arm has a lower modulus of elasticity and the arm will deflect or bend slightly when the target is struck.

A shot indicator 42 is slidably attached to the vertical shaft 12 at a position above the target support means 24. The shot indicator 42 includes a bore hole 44 through which the vertical shaft 12 extends such that the shot indicator 42 can freely slide long a length of the vertical shaft. The shot indicator 42 can be in the shape of a golf ball.

A collar 46 is affixed to the vertical shaft 12 at a distance from the second end 16 thereof. The collar 46 acts as a stop indicator to a user when inserting the vertical shaft 12 into the ground 20 to place the target 22 at a correct height for use.

Figure 2:
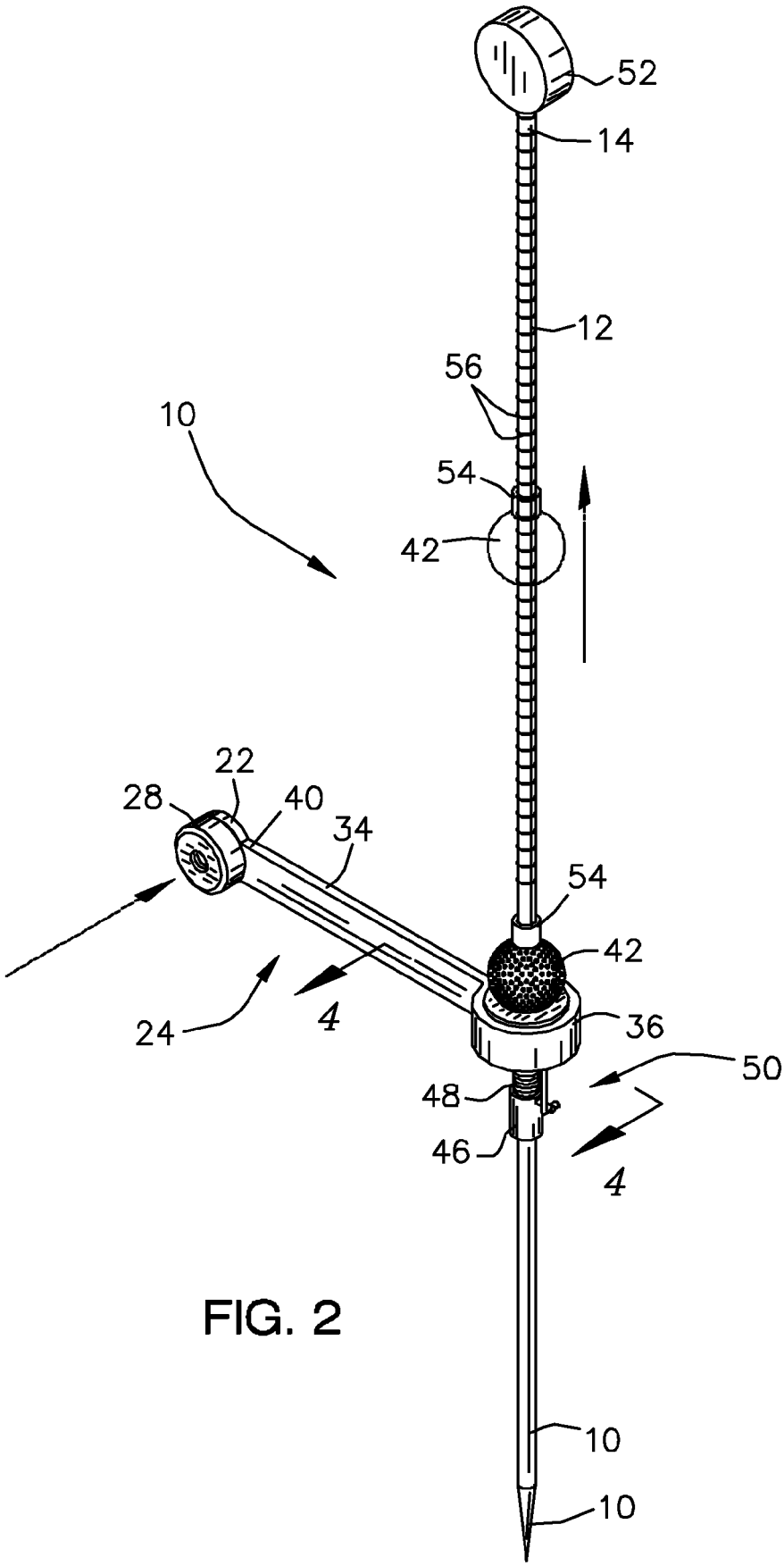
FIG. 2 is a perspective detail view of the apparatus of FIG. 1.
Figure 3:
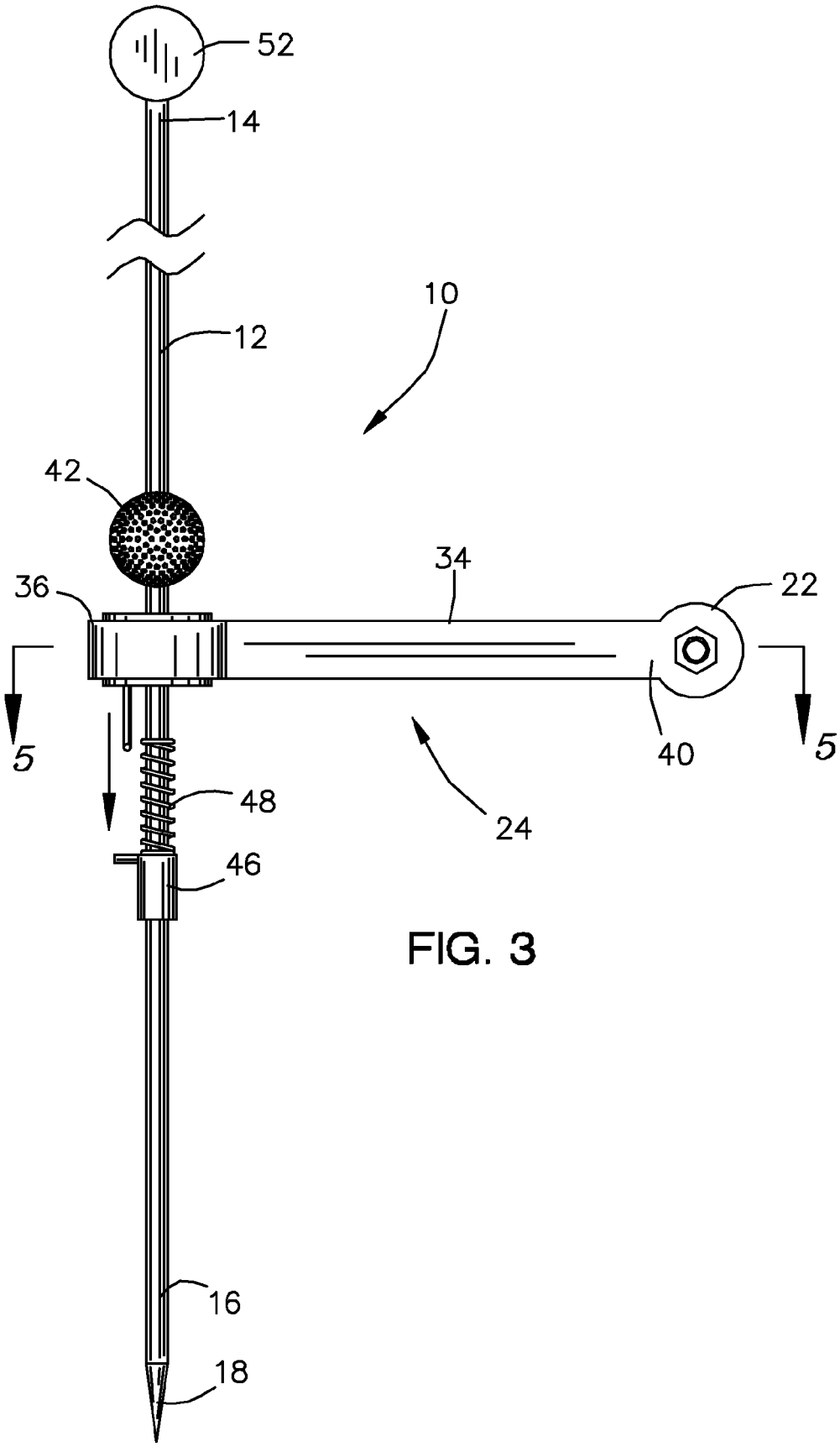
FIG. 3 is a side elevation view of the apparatus of FIG. 1.
Figure 4:
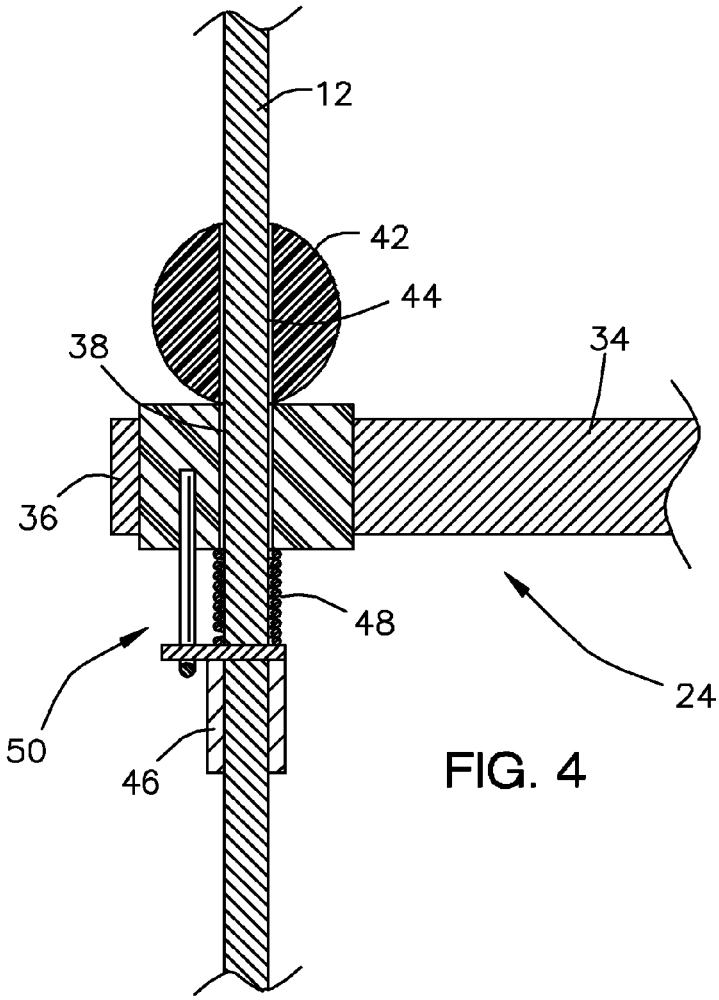
FIG. 4 is a cross sectional view taken along line 4-4 in FIG. 2.
Figure 5:
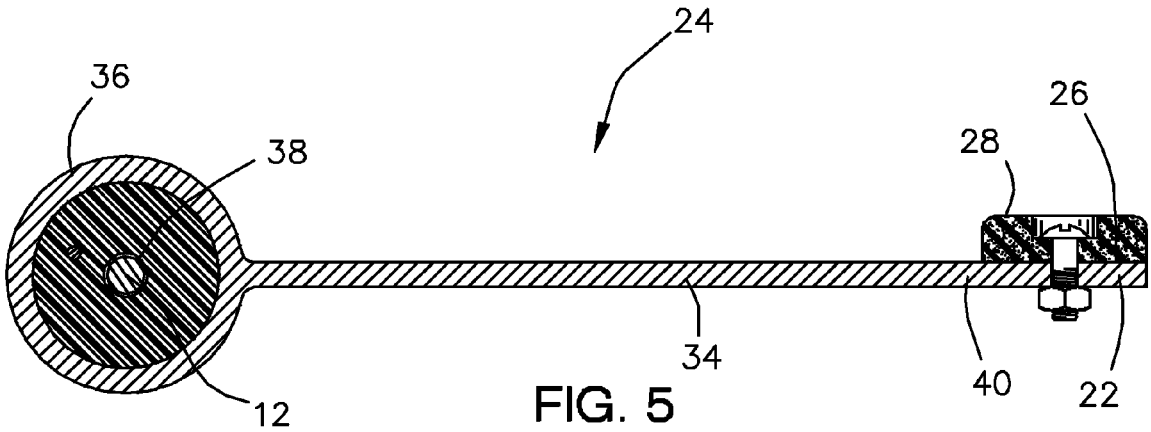
FIG. 5 is a cross sectional view taken along line 5-5 in FIG. 3.

A compression spring 48 is placed about the vertical shaft 12 intermediate the target support means 24 and the collar 46. A latch means 50 is releasably secures the target support means 24 in a position where the compression spring is compressed between the target support means and the collar 46. In this position, the target 22 is positioned for being struck by the head 30 of the golf club 32, as shown in FIGS. 1 and 2. When the target 22 is struck by the club head 30, the target support means 24 is caused to rotate about the vertical shaft 12 releasing the target support means from the latch means 50 allowing the compression spring 48 to abruptly expand. The force of the compression spring 48 expanding is transferred into the shot indicator 42 in a quick impact action causing the shot indicator to rise on the vertical shaft 12.

The height the shot indicator 42 rises on the vertical shaft 12 indicates the effectiveness of the shot in terms of distance of flight which would have been attained by a golf ball if driven by a blow of equal force and direction. The shot indicator 42 will rise higher when the target 22 is struck by a correct golf swing than it will when struck by a not so correct golf swing. A correct golf swing will impact the target 22 in such a way that the target support means 24 rotates about the vertical shaft 12 in a plane normal to the vertical shaft. An in correct golf swing will impact the target 22 in such a way that the target support means 24 rotates about the vertical shaft 12 in a plane that is not normal to the vertical shaft. When the support means 24 rotates about the vertical shaft 12 in a plane that is not normal to the vertical shaft the wall of the bore hole 38 binds against the vertical shaft reducing the spring force transferred into the shot indicator 42 from the compression spring 48 as it expands, thereby reducing the height the shot indicator travels on the vertical shaft.

A stop element 52 is attached to the first end 14 of the vertical shaft 12 preventing the shot indicator 42 from sliding off the vertical shaft and to prevent injury to a user from impacting the first end.

With reference to FIG. 2, the apparatus 10 can further include a height indicator 54 slidably attached to the vertical shaft 12 above the shot indicator 42, and a plurality distance indicators 56 marked along a length of the vertical shaft. The height indicator 54 forms a frictional engagement with the vertical shaft 12 sufficient to only over come the force of gravity on the height indicator so the height indicator will not slide downward along the vertical shaft under its own weight. The frictional engagement negligibly effects the height of the shot indicator 42. The height indicator 54 is pushed up the vertical shaft 12 by the shot indicator 42 as the shot indicator rises on the vertical shaft. The frictional engagement between the height indicator 54 and the vertical shaft 12 causes the height indicator to remain at its highest point of travel along the vertical shaft. A user can than reference the elevation of the height indicator 54 with the distance indicators 56 to read the relative distance a golf ball would have flown.

In use, a golfer would secure the apparatus 10 for use by inserting the second end 16 into the ground 20 until the bottom of the collar 46 is generally flush with the ground surface. To initiate a practice shot, the compression spring 48 is compressed by latching the target support means 24 by the latch means 50. In this position, the target 22 is at the correct elevation and the golfer can address the target with the golf club as a golf ball would be addressed. The golfer swings the club in a normal fashion to strike the target 22 as if the golfer was hitting a golf ball. When the club strikes the target 22, the target support means 24 is caused to rotate about the vertical shaft 12 releasing it from the latch means and allowing the compression spring 48 to expand. The force of the expanding compression spring 48 is transferred into the shot indicator 42 causing the shot indicator to rise on the vertical shaft 12. The golfer observers the height to which the shot indicator 42 rises to get an indication of the effectiveness of the shot in terms of distance of flight which would have been attained by a golf ball if driven by a blow of equal force and direction. The above steps are then repeated for each practice shot.

A number of embodiments of the present invention have been described. Nevertheless, it will be understood that various modifications may be made without departing from the spirit and scope of the invention. Accordingly, other embodiments are within the scope of the following claims.

I claim:

1. An apparatus for the practice and development of golf skills, comprising:

a vertical shaft having opposed first and second ends, said second end being formed into a point allowing said vertical shaft to be inserted into a support surface;

a target;

a target support means for supporting said target at a lateral distance from said vertical shaft, said means for supporting said target being rotatable about said vertical shaft;

a shot indicator having a bore through which said vertical shaft extends such that said shot indicator is slidable along said vertical shaft, said shot indicator being positioned above said means for supporting said target;

a compression spring;

a latch means for releasably securing said compression spring in a compressed position; and wherein rotation of said target support means about said vertical shaft releases said latch means from securing said compression spring in said compressed position allowing said compression spring to abruptly expand causing said shot indicator to rise on said vertical shaft.

2. The apparatus of claim 1, wherein said means for supporting said target includes an arm having a first end with a bore through which said vertical shaft extends and a second end supporting said target.

3. The apparatus of claim 1, wherein said shot indicator is in the shape of a golf ball.

4. The apparatus of claim 1, further comprising a stopper attached to said first end of said vertical shaft.

5. The apparatus of claim 1, further comprising:

a pad attached to a striking surface of said target.

6. The apparatus of claim 1, wherein said target is circular and has a diameter equal to a golf ball.

7. A golf skill development and practice apparatus which indications of the effectiveness of a practice shot in terms of distance of flight which would have been attained by a golf ball if driven by a blow of equal force and direction, the apparatus comprising:

a vertical shaft having opposed first and second ends, said second end being formed into a point;

a target;

a target support means including an arm having one end with a bore hole through which said vertical shaft extends such that said arm is rotatably slidable about said vertical shaft, and a second end supporting said target at a spaced lateral distance from said vertical shaft;

a shot indicator having a bore through which said vertical shaft extends such that said shot indicator is slidable along said vertical shaft, said shot indicator being positioned above said target support means;

a stop collar affixed to said vertical shaft at a spaced distance from said second end of said vertical shaft;

a compression spring being positioned about said vertical shaft intermediate said first end of said target support means and said stop collar;

a latch means for releasably securing said target support means in a position where said compression spring is compressed between said stop collar and said first end of said target support means; and wherein rotation of said target support means about said vertical shaft releases said target support means from said latch means allowing said compression spring to abruptly expand causing said shot indicator to rise on said vertical shaft.

8. The apparatus of claim 7, wherein said shot indicator is in the shape of a golf ball.

9. The apparatus of claim 7, further comprising:

a pad attached to a striking surface of said target.

10. The apparatus of claim 7, further comprising:

a height indicator slidably attached to said vertical shaft; and a plurality of height indicator markings spaced along a length of said vertical shaft.

11. The apparatus of claim 7, wherein said target is free to rest upon said first end of said arm of said target support means.

12. The apparatus of claim 7, wherein said target is circular and has a diameter to correspond to the diameter of a typical golf ball.

13. The apparatus of claim 7, wherein said arm of said target support means is semi-rigid.

14. A golf skill development and practice apparatus which indications of the effectiveness of a practice shot in terms of distance of flight which would have been attained by a golf ball if driven by a blow of equal force and direction, the apparatus comprising:

a vertical shaft having opposed first and second ends, said second end being formed into a point;

a target, said target being circular shaped and having a diameter corresponding to a diameter of a golf ball;

a target support means including a semi-rigid arm having one end with a bore hole through which said vertical shaft extends such that said arm is rotatably slidable about said vertical shaft, and a second end supporting said target at a spaced lateral distance from said vertical shaft;

a shot indicator having a bore through which said vertical shaft extends such that said shot indicator is slidable along said vertical shaft, said shot indicator being positioned above said target support means;

a stop collar affixed to said vertical shaft at a spaced distance from said second end of said vertical shaft;

a compression spring being positioned about said vertical shaft intermediate said first end of said target support means and said stop collar;

a latch means for releasably securing said target support means in a position where said compression spring is compressed between said stop collar and said first end of said target support means; and wherein rotation of said target support means about said vertical shaft releases said target support means from said latch means allowing said compression spring to abruptly expand causing said shot indicator to rise on said vertical shaft.

15. The apparatus of claim 14, further comprising:

a pad attached to a striking surface of said target.

16. The apparatus of claim 14, wherein said target is free to rest upon said first end of said arm of said target support means.

17. The apparatus of claim 14, further comprising:

a height indicator slidably attached to said vertical shaft; and a plurality of height indicator markings spaced along a length of said vertical shaft.

* * * * *

UNITED STATES PATENT AND TRADEMARK OFFICE

CERTIFICATE OF CORRECTION

PATENT NO. : 7,285,054 B1
APPLICATION NO. : 11/737862
DATED : October 23, 2007
INVENTOR(S) : William Morrison It is certified that error appears in the above-identified patent and that said Letters Patent is hereby corrected as shown below:

On the title page, item [76]:

"William Morrision" should read -- William Morrison --

Signed and Sealed this

Twenty-second Day of September, 2009

David J. Kappos

David J. Kappos
*Director of the United States Patent and Trademark Office*